US008414290B2

(12) United States Patent
Gdynia

(10) Patent No.: US 8,414,290 B2
(45) Date of Patent: Apr. 9, 2013

(54) DEVICE FOR IGNITING AND KINDLING A FIREPLACE

(76) Inventor: Jonathan Gdynia, Crailsheim (DE)

( * ) Notice: Subject to any disclaimer, the term of this patent is extended or adjusted under 35 U.S.C. 154(b) by 0 days.

(21) Appl. No.: 11/887,850

(22) PCT Filed: Apr. 3, 2006

(86) PCT No.: PCT/EP2006/003013

§ 371 (c)(1),
(2), (4) Date: Dec. 16, 2008

(87) PCT Pub. No.: WO2006/105923

PCT Pub. Date: Oct. 12, 2006

(65) Prior Publication Data

US 2009/0214994 A1 Aug. 27, 2009

(30) Foreign Application Priority Data

Apr. 4, 2005 (DE) ..... 10 2005 015 520

(51) Int. Cl.

| | |
|---|---|
| ***F23D 14/28*** | (2006.01) |
| ***F23D 14/46*** | (2006.01) |
| ***F23J 7/00*** | (2006.01) |
| ***F23Q 2/00*** | (2006.01) |
| ***F23Q 7/12*** | (2006.01) |
| ***B05B 1/00*** | (2006.01) |
| ***B65D 83/14*** | (2006.01) |

(52) U.S. Cl. ..... 431/344; 431/4; 431/142; 431/255; 431/345; 222/635; 239/597

(58) Field of Classification Search ..... 431/344, 431/153, 255, 345, 264, 142, 4, 125; 239/597; 222/635, 632

See application file for complete search history.

(56) References Cited

U.S. PATENT DOCUMENTS

| | | | | |
|---|---|---|---|---|
| 2,709,542 | A * | 5/1955 | Eller et al. | 222/209 |
| 3,262,447 | A * | 7/1966 | Burke | 128/207.16 |
| 3,806,028 | A * | 4/1974 | Coffey | 239/1 |
| 4,190,034 | A | 2/1980 | Wonisch | |
| 4,395,227 | A * | 7/1983 | Stivers | 431/142 |
| 4,538,983 | A | 9/1985 | Zeller et al. | |
| 4,545,759 | A * | 10/1985 | Giles et al. | 431/344 |
| 4,938,686 | A | 7/1990 | Yoshinaga | |
| 5,476,089 | A * | 12/1995 | Rose | 126/401 |
| 5,549,226 | A * | 8/1996 | Kopp | 222/402.13 |
| 5,582,201 | A * | 12/1996 | Lee et al. | 137/454.2 |
| 2002/0094500 | A1 | 7/2002 | Tse | |
| 2004/0013991 | A1 * | 1/2004 | Miceli | 431/344 |
| 2005/0053875 | A1 * | 3/2005 | Haskew | 431/4 |

FOREIGN PATENT DOCUMENTS

| | | | |
|---|---|---|---|
| DE | 80 33 528 | U1 | 7/1981 |
| DE | 92 17 576 | U1 | 12/1992 |
| DE | 94 12 974 | U1 | 11/1994 |
| DE | 203 03 065 | U1 | 6/2004 |
| EP | 0 660 045 | A2 | 6/1995 |
| JP | 2002 96351 | | 4/2002 |
| WO | WO 97/04970 | | 2/1997 |
| WO | WO 97/06388 | | 2/1997 |
| WO | WO 00/09438 | | 2/2000 |

* cited by examiner

*Primary Examiner* — Kenneth Rinehart
*Assistant Examiner* — William Corboy
(74) *Attorney, Agent, or Firm* — Pauley Petersen & Erickson

(57) ABSTRACT

A device for igniting combustible means, especially solid combustibles such as wood, charcoal, and similar. The device includes a pressurized receptacle that is filled with a combustible medium, a spring-loaded actuating valve which selectively opens and closes a discharge port of the receptacle, preferably by applying pressure with a fingertip, and a top part that is joined to the discharge port and has a tubular extension having an adequate length.

30 Claims, 4 Drawing Sheets

DEVICE FOR IGNITING AND KINDLING A FIREPLACE

BACKGROUND OF THE INVENTION

1. Field of the Invention

For kindling a fire site and/or for igniting solid fuel materials, such as, for example, charcoal for grilling, pieces of firewood or the like, it is known to place a solid grill fire starter, for example saturated with kerosene, petroleum or N-paraffin, into the center of a fire site or grill, to place the solid fuel material around the grill fire starter and to light it with a long match. After the grill fire starter has burned down, the initially small amount of glowing material is kindled by a blower, for example a hair dryer or the like, until the desired size of the glowing material is reached.

2. Discussion of Related Art

In place of the use of a solid grill fire starter, it is also known to splash methylated spirits or the like over the fire site and then to light it, also followed by further kindling of the fire site by a blower.

It is disadvantageous, that there is a considerable danger of causing burns when lighting the grill fire starter with a match or lighter, and that the handling of the solid grill fire starter is unpleasant because its smell adheres to the hands. The handling of liquid fire starters, which are splashed from a container over the fire site, is dangerous, and often there is no electrical outlet in the vicinity of the fire site for operating the blower. The hair dryer which is preferably employed for this quickly shows damage to its outlet nozzle because of the high temperatures at the fire site to be kindled.

An alternative for avoiding the above mentioned problems lies in the use of a blowtorch for igniting and kindling the fire site.

Such a blowtorch is known, for example, from U.S. Pat. No. 4,938,686. Essentially, the blowtorch includes a burner, regulated by an injector needle, in which a gas/air mixture is generated. If the injector needle is in the open position, gas continuously flows through the burner, regardless of whether or not the blowtorch is held in the hand. For turning off the flame, the injector needle must be completely placed into the closed position.

One disadvantage is the high price of gas-operated blowtorches, its complicated and delicate mechanical structure for adjusting the flame, its continuous operation forming a considerable danger of causing burns, even if it is not held by hand, and the relatively large gas bottles by which they are operated. This makes their use by laymen, who otherwise have no use for blowtorches, uneconomical, complicated and dangerous.

A lighter is known, which includes a small container of combustible gas, an annular element attached to it and which has a built-in valve and ignition switch, and an extension tube, which is connected to the annular element and has a nozzle at its free end. The container can hold only a little gas, and the extension tube only has a length of approximately 5 cm, so that the lighter is only suitable for igniting small, easily ignitable fire sites, such as the gas in gas stoves, or candles.

SUMMARY OF THE INVENTION

It is one object of this invention to provide a device with which solid combustible materials can be ignited, as well as fire sites kindled, wherein handling of the device is to be dependable, simple and cost-effective, as well as the operation of the device independent of additional aids, such as electrical energy, for example, grill lighters, or the like.

This object is attained with a device having characteristics taught in this specification and in the claims.

It is possible with a device in accordance with this invention to light extensive fire sites, such as charcoal grills, fireplaces or camp fires, and to provide them with additional fuel for accelerating burning, without the safety of the user being endangered.

The spring-loaded valve closes immediately when it is no longer needed. In comparison with a blowtorch, for example, this substantially increases the safety when handling the device in accordance with this invention.

The length of the tube-shaped extension is selected so that neither a burning medium flowing out through the tube-shaped extension, nor a fire site to be ignited by the device, results in burns of a user or in an impermissible heating of the container, for example above 50° C. It is thus possible to create a controllable flame at an end of the tube-shaped extension, which neither results in burns of the user nor in excessive heating of the container itself. Beyond this, by the tube-shaped extension it is also possible to maintain a safe distance from the fire site to be ignited. Furthermore, the tube-shaped extension also provides a defined exit angle of the combustible medium, which preferably is less than, for example, the exit angle from a commercially available spray can.

Also, the exiting stream creates an air movement which permits, for example, the improvement of the oxygen supply to a charcoal grill, so that lighting of the charcoal, as well as the kindling of already existing coals, is possible. Thus, the device in accordance with this invention allows the omission of aids in the form of blowers or the like.

It is possible to store a sufficient amount of fuel for large fire sites in the container in accordance with this invention, which preferably corresponds in a volume to a commercially available spray can. Furthermore, a sufficient safe distance is maintained by the long extension which, for example, is embodied as a spray tube. The outflow speed of the fuel can also be regulated by the push-bottom valve, which preferably includes the headpiece and the actuating valve.

An advantageous embodiment of this invention provides for the container to be a commercially available spray can. Such spray cans are known per se and are used, for example, for the atomization of deodorants, air fresheners, paints, etc. An embodiment of the device in the form of a spray can has the advantage that handling is greatly simplified. Customarily, a spray can is comprised of a container, which is under pressure by a propellant medium and contains a liquid, such as a lacquer or the like, a discharge opening, an actuating valve, as well as a spray head. The discharge opening is closed by a spring-loaded valve. Pressing the valve down opens the discharge opening. The headpiece designed as a spray head is arranged on the discharge opening and has, with the container in an upright position, an outlet opening which is approximately horizontally oriented. The spray head can be pushed down by a finger tip, so that the actuating valve is actuated and the discharge opening is released. Everybody knows how to handle a spray can. With the device in accordance with this invention, embodied as a spray can, the tube-shaped extension is arranged on the discharge opening of the spray head, so that handling of the device in accordance with this invention essentially continues to correspond to the simple handling of a spray can. The tube-shaped extension here permits the ignition of combustible materials or the further kindling of already ignited fire sites, without the danger of burns for the user and without the danger of excessive heating of the spray can. For this purpose, the spray can is filled with fuel in the form of a combustible medium, wherein preferably no health-endangering combustion products are created when it is burned.

Spray cans with tube-shaped extensions are for example known from Japanese Patent Reference JP 2002 96351 A, German Patent References DE 68033528 U1 and DE 20303065 U1, PCT Reference WO 97/04970 and German Patent Reference DE 9217576 U1. There, the tube-shaped extensions are used for applying the substances contained in the spray cans, for example lubricants, pesticides, paints and lacquers, sealing foams, as well as adhesion improvers, to surfaces which are hard to reach. For applying such substances to surfaces which are in particular accessible at an angle, a tube-shaped extension, comprised of a flexible tube with a plastically deformable element laterally worked into the tube is from PCT Reference WO 00/09438. This tube is used for being able to curve the tube arbitrarily and to maintain it in this shape.

All of these applications have in common that the tube-shaped extensions are not made of heat-resistant materials and that the spray cans are not filled with a combustible medium suitable for igniting or kindling a fire site. Thus, they substantially differ from the device in accordance with this invention, which includes a container embodied as a spray can.

In one embodiment of this invention, the combustible material is a combustible gas under pressure, for example a liquid gas, and/or a combustible liquid under pressure by a propellant gas. In case of the latter it is possible for the propellant gas itself to be a combustible gas. Under normal conditions, liquid or gaseous hydrocarbons are provided as the combustible medium. In this case, the combustible medium can comprise a gas, as well as a liquid which exits in the form of an aerosol when the valve is opened. The liquid combustible medium is preferably comprised of isopropanol. The combustible medium is preferably comprised of propane, butane, pentane, or a higher hydrocarbon, an alcohol of such hydrocarbon, or a mixture of one or several hydrocarbons and/or one or several of their alcohols.

In one embodiment of this invention, the tube-shaped extension connected with the discharge opening has a predetermined bending section, so that the tube-shaped extension can be flipped against the container for storage when not in use. For storing the device in accordance with this invention, it is possible to separate the headpiece together with the tube-shaped extension from the container wherein there is the danger that the discharge opening would become dirty and/or dirt would stick inside the tube-shaped extension or in the headpiece. In connection with a predetermined bending section, this problem is simply solved because, when not in use, the headpiece also remains arranged on the discharge opening, for example inside a sales package, and only the tube-shaped extension is flipped against the container by the predetermined bending section.

In another embodiment of this invention, a taper is arranged in the discharge opening of the container or in the headpiece or in the tube-shaped extension in the area of their connection with the headpiece. This taper is used as a pressure reducer for preventing the headpiece from lifting off the discharge opening. For example, the taper can be embodied as a plug, which can be inserted into the discharge opening and as a small thinner tube passing through the plug and projecting into the discharge opening.

It is also advantageous to position a throttle in the discharge opening of the container. The throttle is used to prevent the headpiece from lifting off because of the overpressure prevailing in the container when the actuating valve is opened and the combustible medium flows through the headpiece. No special steps need to be taken for preventing the lift-off of the headpiece, such as an arrangement of flanges, undercuts or the like, for example. The throttle can be embodied in the form of a tube section 5', for example, one end of which protrudes into the container and the other end into a conduit arranged in the headpiece. The tube section is preferably 5 mm to 25 mm long and has an interior diameter between 0.001 mm and 0.9 mm. The selection of the throttle, or the selection of the interior diameter of the tube section, depends on the filling pressure of the container.

In one embodiment of this invention, on its free end the tube-shaped extension has a first taper and, distanced from the free end, preferably at the end connected to the headpiece, a second taper. Similar to a stabilization chamber, a retaining chamber forms between the tapers, which causes a more uniform exit of the combustible medium at the free end of the tube-shaped extension. In connection with a two-phase mixture, a more uniform distribution of the droplets of liquid in the exiting flow is thus achieved, so that a fog is created, which is particularly well capable of combustion and which can be directed in an aimed manner through the taper at the free end. The taper is preferably provided by pinching the tube-shaped extension. In accordance with an advantageous embodiment, the taper at the free end is formed as a nozzle comprising a purposely created narrowest cross section.

A sheath with air holes is preferably arranged around the free end of the tube-shaped extension. This simple embodiment assures excellent atomization of the fuel. At least the sheath is preferably made of a heat-resistant non-flammable material. Preferably, the tube-shaped extension, as well as its nozzle-shaped first end, for example, is made of a heat-resistant non-flammable material, the same as the sheath.

The tube-shaped extension preferably has a length of 15 cm to 60 cm, preferably of 20 cm to 30 cm, and particularly preferred at 20 cm. The tube-shaped extension is screwed or inserted into the outlet of the discharge opening at the headpiece.

In accordance with one embodiment, a corrugated tube is fastened to the outlet of the headpiece, wherein a flexible hose can be pushed in a frictionally connected manner onto the corrugated tube, wherein the tube-shaped extension is fastened to the end facing away from the headpiece. In this case, the corrugated tube is used as the predetermined bending section. It is thus possible to direct the spray tube into different directions by bending the hose. It is thus possible for the flexible hose to be made of a plastic material, which contracts under heat of more than 50° C. and stops the flow of combustible material. The safety of the user is thus increased. In the same way, it is possible to provide a bimetallic arrangement in the tube-shaped extension directly closely to its end or to the nozzle, which stops the fuel flow in case of too high a temperature. The safety of the user is thus increased.

In accordance with a further embodiment of this invention, the tube-shaped extension is bent substantially at right angles in an area located near the headpiece and is rotatably arranged in the outlet of the headpiece. With this the spray tube can also be directed in various directions. It is thus possible for a clamping retainer to be arranged on the container, which is designed for holding the tube-shaped extension. Because of this the spray can and the spray tube can be maintained close together in the non-operating state.

For actuating the actuating valve of the device in accordance with this invention, the headpiece is preferably pushed down with a finger tip.

In one embodiment of this invention, a method relates to igniting combustible materials, in particular solid combustible materials, such as wood, charcoal for grilling and the like, for example, which provides the application of an above described device, wherein the longitudinal axis of the tube-shaped extension takes up an angle between 0° and 90° with a vertical line oriented to the center of the earth.

BRIEF DESCRIPTION OF THE DRAWINGS

This invention is explained in view of exemplary embodiments shown in the drawings, wherein.

DETAILED DESCRIPTION OF THE INVENTION

Figure 1:
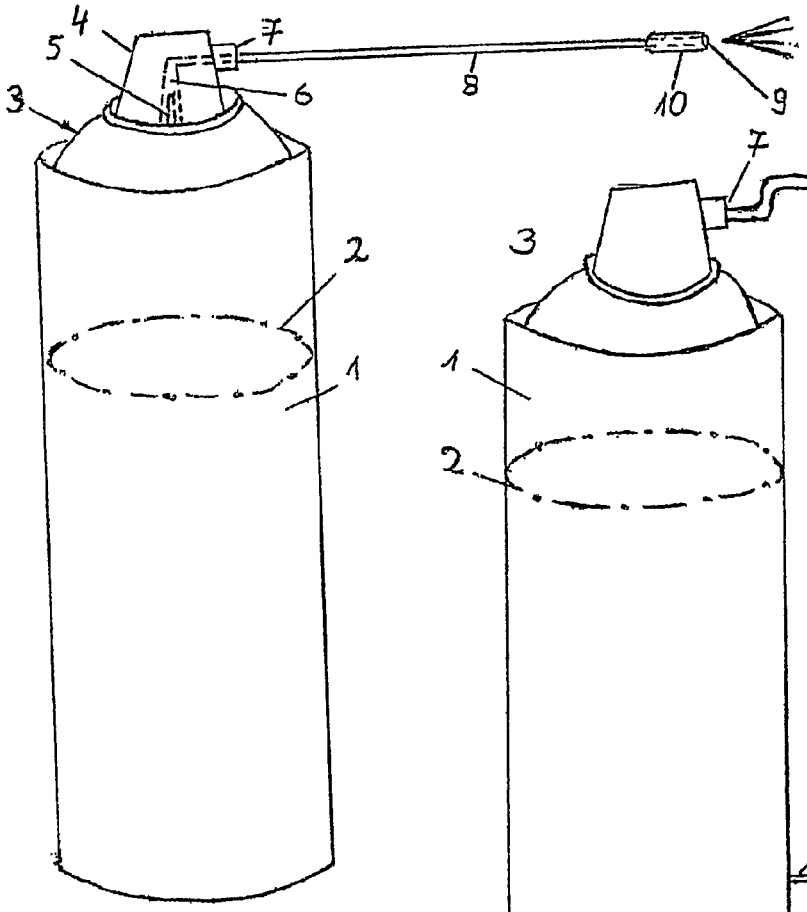
FIG. 1 shows a perspective view of a first embodiment of a spray can in accordance with this invention, with a spray tube oriented at right angles with respect to the longitudinal axis of the spray can.

One device in accordance with this invention is explained in view of the exemplary embodiment of a container in the form of a spray can. Here, the device in accordance with this invention comprises a container embodied as a spray can 1, having a gaseous or liquid fuel 2 under pressure and a spray head 3, which has a valve and a push button 4 actuating the valve and connects the valve outlet 5 with a push button outlet 7 via a push button conduit 6, wherein the spray agent 2 is combustible, and wherein a spray tube 8, 8', 8", at least 20 cm long and made of a non-flammable material and has a nozzle 9 at a free end, such as shown in FIGS. 1 and 2, can be connected to the push button outlet 7.

Figure 2:
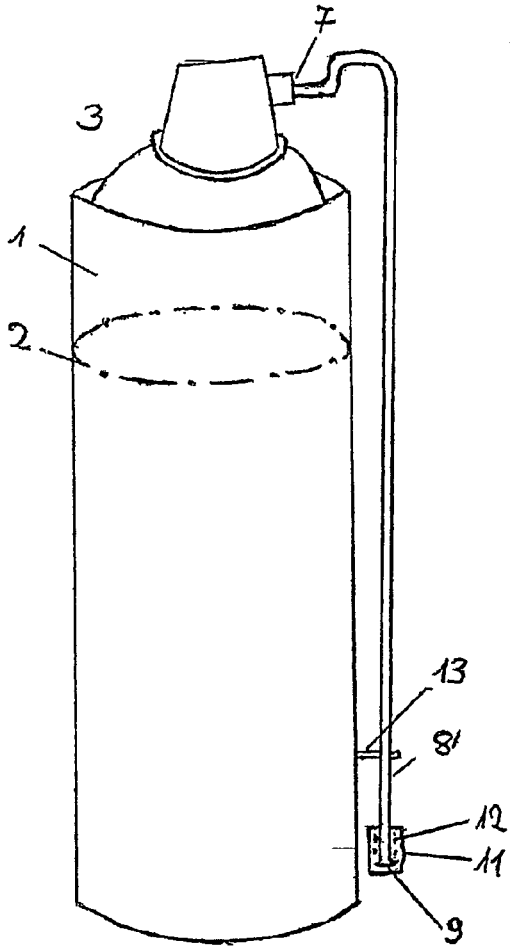
FIG. 2 shows a perspective view of a second embodiment of a spray can in accordance with this invention, with a spray tube which can be clamped to the spray can.
Figure 3:
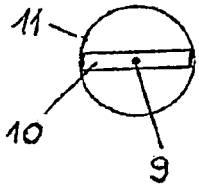
FIG. 3 shows a front view of a nozzle as shown in FIGS. 1 and 2.

A conventional, cylinder-shaped spray can 1, which is filled with a fuel 2, is shown in FIG. 1. This fuel can be gaseous or liquid. For example, methylated spirits or butane can be employed as the fuel, and this fuel can be under pressure by a customary propellant. The spray can has a spray head 3, which has a valve, not further represented, and a push button 4 actuating the valve. The push button 4 can be snapped onto the spray can 1, and during this it can be connected with a hollow tappet 5 in a frictionally connected manner and has a push button conduit 6, which connects the tappet 5 with a push button outlet 7. The push button 4 is embodied so that it can be actuated from above by a finger; however, for actuation it can also be actuated in a manner not represented by a lever or a handle. A spray tube 8, at least 20 cm long and made of a non-combustible material, preferably metal, having a nozzle 9 on its end, can be connected with the push button outlet 7. The spray tube 8 can be screwed to or inserted into the push button outlet 7. In accordance with FIG. 3, the nozzle 9 is preferably formed by pinching the free spray tube end 10, and by a metal sheath 11 with air holes 12, as shown in FIG. 2, surrounding the spray tube end 10.

After pushing the push button 4, the fuel 2 flows into the spray tube 8 via the conduit 6, and then exits from the nozzle 9. In the process, the fuel 2 is mixed with the air flowing over the metal sheath 11, because of which the quality of the acceleration of burning is increased. Now, the fuel mixture is ignited by a fire source, for example a lighter, and is thereafter conducted to the prepared charcoal, the camp fire site or the fireplace site. Because of this the combustible material starts burning in a few seconds. This process can be repeated often, until the desired fire is established.

There is no danger of an explosion, such as with an open fire accelerator, because the fuel mixture burns instantly and there is a safe distance of at least 20 cm between the spray can and the fire. The fire can be evenly distributed without a long waiting time until the combustible material is lit. The desired temperature of the combustible material is reached in a few minutes by the fire accelerator.

An alternative embodiment of the customary cylinder-shaped spray can 1', which is filled with a fuel 2 and provided with a spray head 3 as in FIG. 1, is shown in FIG. 2. In a different way, the spray tube 8' is substantially bent at right angles in the area near the spray head outlet 7 and is arranged to be rotatable in it. Also, a clamping retainer 13 is arranged on the spray can 1', into which the spray tube 8' can be clamped in the state in which it is not in use. For operation, the spray tube 8' can be released from the clamping retainer 13 and can be rotated upward into different positions.

Figure 4:
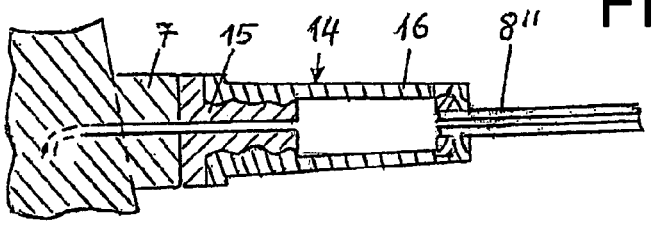
FIG. 4 shows one embodiment of a connecting arrangement located between the spray can head and the spray tube.

An additional connection arrangement 14 is shown in FIG. 4, which connects the push button outlet 7 with a spray tube 8". This connection arrangement 14 comprises a corrugated tube 15 fastened to the push button outlet 7, onto which a flexible hose 16 is pushed in a frictionally connected manner. The spray tube 8" is fastened to the free end of the hose 16. Because of the flexibility of the hose 16, the spray tube 8" can be directed into different directions. The flexible hose 16 is preferably made of a plastic material which contracts when exposed to heat in excess of approximately 50° C. and for safety reasons prevents the flow of fuel through spray tube 8". Although this process cannot be reversed automatically, the connection arrangement 14 can be easily replaced.

A further safety measure results, in a manner not represented, when a bimetallic arrangement is provided in the spray tube 8, or 8', or 8" directly behind the nozzle 9 which, in case of an excessive temperature, stops the flow-through of fuel. After the bimetallic arrangement is cooled, the fuel flow is possible again.

While employing the device it has been found that it is possible to optimally maintain a flame if the outlet is downwardly directed and the axis of the spray tube encloses an angle with respect to a horizontal line which is greater than 10°.

An optimal flame is achieved when the axis extends approximately vertically with respect to the horizontal line.

This is also probably connected with the fact that, if the tube outlet is not directed upward, the outflowing gases and fluids back up in the course of flowing out.

Figure 5:
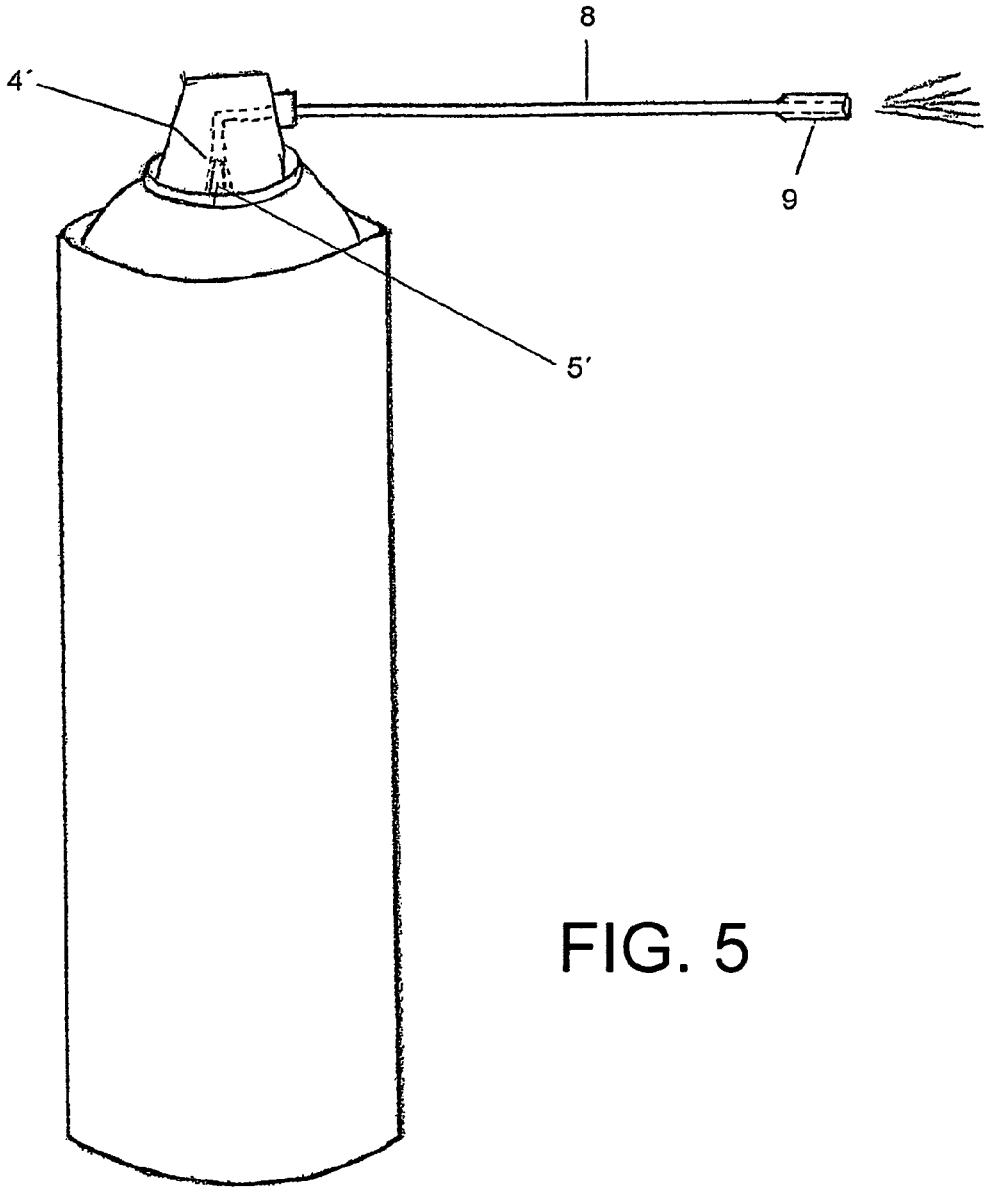
FIG. 5 shows a third embodiment of a spray can in accordance with this invention, with a universal push button and a spray tube arranged thereon.

In the universal push button 4' shown in FIG. 5, the push button conduit 6' is designed to conically taper from the bottom to the top. Thus, the push button conduit 6' can be adapted to any arbitrary valve size, or any arbitrary diameter of the tappet 5'. The spray tube 8, and also the nozzle 9, are made of a non-combustible material, which is temperature-resistant up to 650° C.

Figure 6:
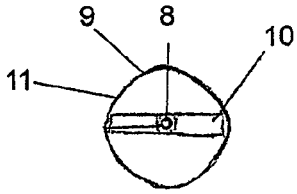
FIG. 6 shows a front view of a nozzle as shown in FIGS. 1 and 2, in an alternative embodiment.

In an alternative embodiment of the nozzle 9 with the sheath 11, shown in FIGS. 1 and 2, is represented in FIG. 6. Here, the free end 10 of the spray tube 8 is pinched, for example it has a greater diameter between its ends than at the free end 10. The front view in FIG. 6 shows that the spray tube 8 is pinched flat at its front end, so that a taper is formed. The sheath 11 is arranged around the pinched-flat free end 10, forming the nozzle 9, of the spray tube 8. The nozzle hole is conically designed, so that a definite, narrowest diameter is created at the nozzle outlet. Thus, the spray tube 8 and the nozzle 9 are made in one piece.

Figure 7:
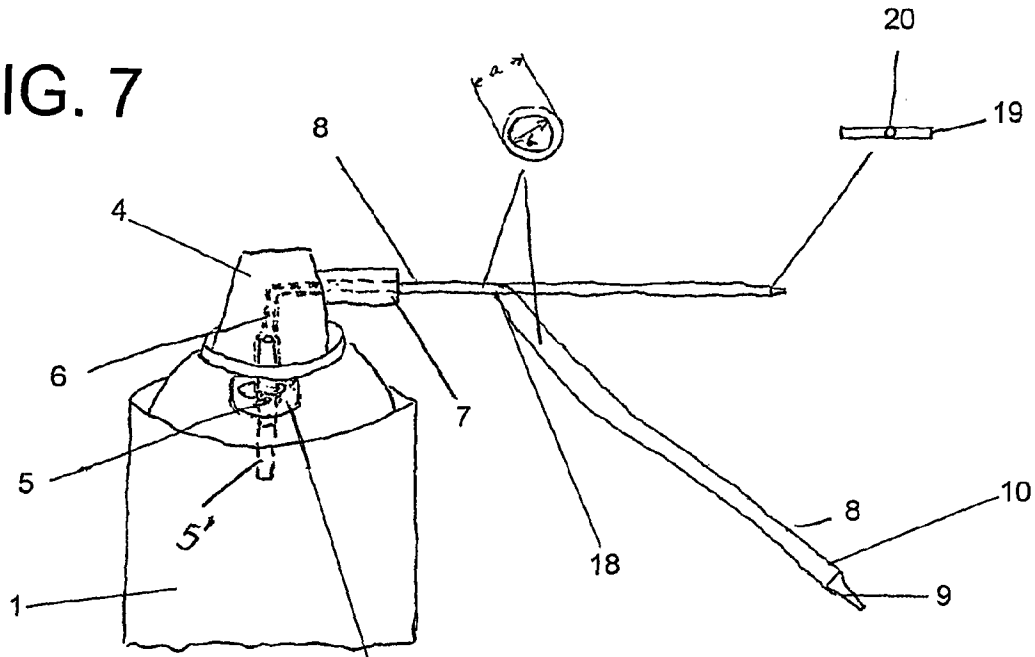
FIG. 7 shows a detailed plan view of a spray can with a spray tube having a predetermined bending section.

A spray head 3 is shown in FIG. 7 in which, for an improved sealing of the push button 4 with respect to the discharge opening of the spray can 1, the push button 4 has a seal ring 17, which is preferably made of rubber. In this way, there is no unexpected burning of fuel exiting in the area of the spray head 3 in an uncontrolled manner. Also, the push button conduit 6 has a taper acting as a throttle. Alternatively, it is advantageous to install a throttle in the form of a tube section in the tappet 5 surrounding the discharge opening. The throttle prevents the lifting of the push button 4 from the tappet when the valve is actuated by reducing the pressure under which the fuel 2 is in the spray can 1, when it exits the spray can 1. The spray tube 8 has a predetermined bending section 18, with which the free end 10 with the nozzle 9, embodied there as a taper of the spray tube 8. The push button outlet 7 is designed to widen conically and has a width of 2.5 mm at the front and a width of 1.8 mm at the back. Thus, the spray tube 8 can be pushed solidly into the push button outlet 7 and can, for example, be glued or pressed in from the front for fixing it in place. The spray tube 8 has an exterior diameter a of preferably 2.0 mm to 2.5 mm and an interior diameter b of preferably 1.4 mm to 1.5 mm. The nozzle-shaped taper 20 has a width of 0.34 mm to 0.55 mm. The spray tube 6 can be arranged fixed, as well as screwable, in the push button outlet 7. Preferably, the spray tube 6 is made of brass and has a length of 15 cm to 53 cm.

Figure 8:
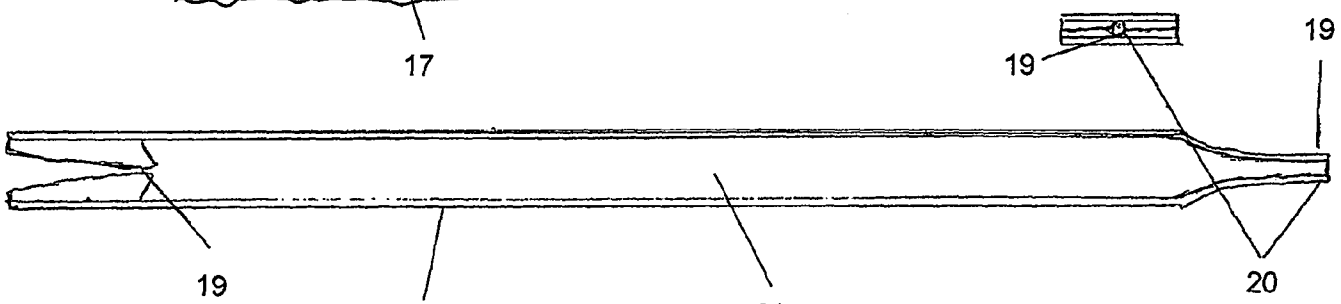
FIG. 8 shows a detailed plan view of a preferred embodiment of a spray tube with a stabilization chamber thereon.

The spray tube 8, shown in detail in FIG. 8, preferably has tapers 19 at both ends. With this a retaining chamber 21 is created in the spray tube 8 between the two ends, which acts in the manner of a stabilization chamber and causes a more uniform exit of the combustible medium from the free end of the spray tube 8. In connection with a two-phase mixture in particular, a more uniform distribution of the drops of liquid in the exiting flow is achieved, so that a particularly easily combustible fog is created which, moreover, can be exactly directed by means of the nozzle-like taper 20 of the free end. The tapers 19 are formed by pinching the spray tube 8. The taper 20, embodied as a nozzle at the free end of the spray tube 8, comprises an expressly created narrowest cross section at the outlet. For pressure reduction, the taper 19, represented at the left in FIG. 8, has a conically tapering opening of a diameter of 0.182 to 0.32 mm. As shown in the detailed plan view in FIG. 8, the nozzle-shaped taper 20 is produced by pressing, wherein the spray tube is pressed flat. Here, the outlet opening has a conically tapering width of 0.34 to 0.55 mm.

The tapers 19, 20 can also be cut in a star shape, because of which the exterior dimensions of the spray tube 8 are not changed.

The invention claimed is:

1. A device for igniting combustible materials, including solid fuels, the device comprising:

a container under pressure and filled with a combustible medium;

a spring-loaded actuating valve selectively opening and closing a discharge opening of the container by pressure, a headpiece connected with the discharge opening;

a corrugated tube fastened to an outlet of the headpiece;

a flexible hose pushed in a frictionally connected manner onto the corrugated tube; and a tube-shaped extension of a suitable length fastened to an end of the flexible hose facing away from the headpiece, wherein an inner diameter of the flexible hose is larger than an inner diameter of each of the corrugated tube and the tube-shaped extension.

2. The device according to claim 1, wherein the tube-shaped extension is inserted into a free end of the flexible hose that is opposite the corrugated tube.

3. The device in accordance with claim 1, wherein the container comprises a spray can (1) and the combustible medium is a combustible gas maintained under pressure by a propellant gas.

4. The device in accordance with claim 1, wherein the flexible hose (16) is made of a plastic material which contracts under an effect of heat greater than 50° C. and stops the flow of combustible material (2).

5. The device in accordance with claim 1, wherein the tube-shaped extension (8, 8', 8") connected with the discharge opening (5) has a predetermined bending section (18).

6. The device in accordance with claim 1, wherein a taper is arranged in at least one of the discharge opening (5) of the container (1) or the headpiece (4).

7. The device in accordance with claim 6, wherein a throttle is positioned in the discharge opening (5) of the container (1).

8. The device in accordance with claim 1, wherein the tube-shaped extension comprises a pinched taper at a free end and tapering toward a nozzle outlet opening (9, 20).

9. A device for igniting combustible materials, including solid fuels, the device comprising:

a container (1) under pressure and filled with a combustible medium (2), a spring-loaded actuating valve selectively opening and closing a discharge opening (5) of the container (1) by pressure;

a headpiece (4) connected with the discharge opening; and a tube-shaped extension (8, 8', 8") of a suitable length extending from the headpiece (4) and including a connection end connected to the head piece (4) and a free end (10) opposite the connection end, the tube-shaped extension (8, 8', 8") pinched at the free end (10) to provide a first taper (19, 20) tapering to a nozzle outlet opening (9, 20) having a first reduced area at the free end (10), and the tube-shaped extension (8, 8', 8") pinched at the connection end (10) to provide a second taper (19, 20) tapered toward the free end (10) to a taper opening having a second reduced area.

10. The device according to claim 9, further comprising a stabilization chamber disposed between the first taper and the second taper, the stabilization chamber having an internal diameter that is larger than an internal diameter of each of the first taper and the second taper.

11. The device according to claim 9, wherein the stablization chamber has an internal diameter of 1.4 mm to 1.5 mm, the nozzle outlet opening (9, 20) has a diameter of 0.34 mm to 0.55 mm, and the taper opening has a width of 0.182 mm to 0.32 mm.

12. The device in accordance with claim 9, wherein the taper (19) at the free end (10) is pressed flat around the nozzle outlet opening (9, 20).

13. The device in accordance with claim 9, wherein the container comprises a spray can (1) and the combustible medium is maintained under pressure by a propellant gas.

14. The device in accordance with claim 13, wherein the combustible medium comprises a gas, and a liquid, and exits as an aerosol when the valve is opened.

15. The device in accordance with claim 13, wherein the combustible medium comprises isopropanol.

16. The device in accordance with claim 13, wherein the combustible medium comprises at least one of propane, butane, pentane, a higher hydrocarbon, an alcohol of a hydrocarbon, and a mixture of at least one of one or several hydrocarbons and one or several of their alcohols.

17. The device in accordance with claim 9, wherein the tube-shaped extension (8, 8', 8") connected with the discharge opening (5) has a predetermined bending section (18).

18. The device in accordance with claim 9, wherein a further taper is arranged in at least one of the discharge opening (5) of the container (1) or the headpiece (4).

19. The device in accordance with claim 9, wherein a throttle is positioned in the discharge opening (5) of the container (1).

20. The device in accordance with claim 19, wherein the throttle is formed as a tube section (5'), one end of which protrudes into the container (1) and the other end of which protrudes into a conduit (6) arranged in the headpiece (4).

21. The device in accordance with claim 20, wherein the tube section is sealingly and fixedly connected with the discharge opening, is 5 mm to 25 mm long and has an interior diameter between 0.001 mm and 0.9 mm.

22. The device in accordance with claim 9, wherein a sheath (11) with air holes (12) is arranged around the free end (10) of the tube-shaped extension (8, 8', 8").

23. The device in accordance with claim 22, wherein the tube-shaped extension (8, 8', 8") has a length of 15 cm to 60 cm.

24. The device in accordance with claim 22, wherein the tube-shaped extension (8) is one of screwed and inserted into the outlet (7) of the headpiece (4).

25. The device in accordance with claim 9, further comprising a corrugated tube (15) fastened to an outlet (7) of the headpiece (4), a flexible hose (16) pushable in a frictionally connected manner onto the corrugated tube, and the tube-shaped extension (8") fastened to an end facing away from the headpiece (4), wherein the flexible hose (16) is made of a plastic material, which contracts under an effect of heat greater than 50° C. and stops the flow of combustible material (2).

26. The device in accordance with claim 9, wherein the tube-shaped extension (8') is bent substantially at two right angles near the headpiece (4) and is rotatably arranged in the outlet (7) of the headpiece (4).

27. The device in accordance with claim 9, wherein a clamping retainer (13) is arranged on the container (1) which is designed for holding the tube-shaped extension (8').

28. The device in accordance with claim 9, wherein a bimetallic arrangement is one of in the tube-shaped extension directly prior to an end, and at the nozzle which stops the fuel flow when a temperature is too high.

29. The device in accordance with claim 9, wherein for actuating the actuating valve, the headpiece (4) is pushed down with a finger tip.

30. The device in accordance with claim 9, wherein the combustible materials include solid combustible materials and a longitudinal axis of the tube-shaped extension (8, 8', 8") takes up an angle between 0° and 90° with a vertical line oriented to a center of earth.

* * * * *

UNITED STATES PATENT AND TRADEMARK OFFICE

CERTIFICATE OF CORRECTION

PATENT NO. : 8,414,290 B2
APPLICATION NO. : 11/887850
DATED : April 9, 2013
INVENTOR(S) : Jonathan Gdynia It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 301 days.

Signed and Sealed this
Twenty-fourth Day of December, 2013

Margaret A. Focarino

Margaret A. Focarino
*Commissioner for Patents of the United States Patent and Trademark Office*